United States Patent [19]

Manthei

[11] 4,240,277

[45] Dec. 23, 1980

[54] TWO-PIECE LIQUID RINSE AGENT DISPENSER FOR CLOTHES WASHING MACHINE

[75] Inventor: Philip J. Manthei, Ripon, Wis.

[73] Assignee: Raytheon Company, Lexington, Mass.

[21] Appl. No.: 84,723

[22] Filed: Oct. 15, 1979

[51] Int. Cl.[3] ..... D06F 39/02

[52] U.S. Cl. ..... 68/17 A

[58] Field of Search ..... 68/17 A; 366/130

[56] References Cited

U.S. PATENT DOCUMENTS

| | | | |
|---|---|---|---|
| 2,500,611 | 3/1950 | Kereluck | 366/130 X |
| 2,868,006 | 1/1959 | Tingley, Jr. | 68/17 A X |
| 3,091,954 | 6/1963 | Bullock et al. | 68/17 A X |
| 3,334,499 | 8/1967 | Cartwright | 68/17 A X |
| 3,620,054 | 11/1971 | Drews et al. | 68/17 A |
| 4,118,957 | 10/1978 | Marcussen | 68/17 A |

*Primary Examiner*—Philip R. Coe

*Attorney, Agent, or Firm*—Robert W. Hoke, II; Steven R. Gustafson

[57] ABSTRACT

A two piece liquid rinse agent dispenser for use in a top loading automatic clothes washing machine, includes an inner annular member having a central, hollow hub for mounting the dispenser on the agitator of the machine, a first annular wall joined to the hub to define therebetween a first rinse agent receiving chamber having an open upper end and an outwardly extending flange or base wall joined to the hub, including a depending annular wall having external threads formed thereon. An outer cover member of the dispenser comprises an inverted cup dimensioned for receipt over the inner annular member. The upper wall of the outer member defines an opening through which liquid rinse agent is poured into the first chamber. Internal threads are formed along the interior wall of the rim of the cup for mating engagement with the external threads of the inner annular member. The side wall of the cover member, the first annular wall and base wall of the inner annular member cooperate to define a second chamber into which the liquid rinse agent is transferred by high speed rotation of the dispenser and from which the liquid rinse agent is dispensed into the clothes carrying basket of the washing machine.

10 Claims, 5 Drawing Figures

TWO-PIECE LIQUID RINSE AGENT DISPENSER FOR CLOTHES WASHING MACHINE

BACKGROUND OF THE INVENTION

This invention relates generally to a liquid dispenser device for an automatic clothes washing machine and more particularly to such a device designed to be mounted on the clothes agitator thereof and automatically dispense liquids, such as, for example, rinse agents, during the operation of the machine.

Automatic dispenser devices for use in dispensing liquid rinse agents and the like into the wash basket of an automatic clothes washing machine during the operation of the machine, are well known in the art. One such dispenser device, described in U.S. Pat. No. 2,868,006, is of the type which is designed to be mounted on the agitator of the clothes washing machine. Liquid rinse agent is placed into a first, inner compartment or chamber of the dispenser device upon initiation of the washing operation. During the wash cycle, while the agitator oscillates, the liquid agent remains in the inner compartment. Thereafter, during the spin cycle, the liquid agent is acted upon by centrifugal force created by the rotation of the dispenser on the agitator, moving the liquid agent into an outer chamber of the device. Exit openings communicating with the outer compartment permit the liquid rinse agent to be dispensed into the rinse water.

While the principle of operation of the liquid dispenser is sound, being of one piece construction, cleaning the device subsequent to use can be difficult. To overcome this disadvantage, a device of the type described has been fabricated in two or more separable parts. Examples of such dispenser devices are illustrated in U.S. Pat. No. 3,620,054 and 4;118,957.

The dispensers illustrated in the last-mentioned prior art patents include inner and outer annular members, both of which are mounted on the agitator of the clothes washing machine and joined together by a friction fit. In one case, the dispenser device comprises inner and outer annular members having mating male and female threaded portions at the axes of rotation thereof for joining the two members. Because of this method of joining the inner and outer members, this dispenser, it appears, must be manufactured with precision to avoid imbalance and wobble when the device is spun on the agitator.

While the two piece dispenser devices of the above mentioned patents function satisfactorily for the most part to permit cleaning thereof subsequent to the use of the device, because of the construction of these devices, there is a good possibility that after prolonged use, excessive fatiguing of the members may occur, rendering the device ineffective. Furthermore, liquid rinse agent must be poured over a portion of the support structure of the outer annular member of the device. This can cause a splashing of the rinse agent away from the device and a premature entry of the rinse agent into the washing machine clothes basket. Also, special sealing along the perimeters of the inner and outer annular members of these devices is essential to insure that no leakage of liquid agent occurs from the device.

SUMMARY OF THE INVENTION

Accordingly, it is a primary object of the present invention to provide a new and improved multi-piece liquid dispenser device for use in an automatic clothes washing machine, which device overcomes the disadvantages of the prior art multi-piece devices.

It is another object of the present invention to provide a new and improved two-piece liquid dispenser device of the above-described type which is relatively simple in construction, easy to use and to clean and which operates effectively to dispense liquid rinse agent into the rinse water of an automatic clothes washing machine during the operation thereof.

Briefly, a preferred embodiment of the two-piece liquid rinse agent dispenser according to the invention includes an inner annular member having a central, hollow, generally conically shaped hub closed off at the upper end by a top wall, the hub being designed for receipt on the agitator of a clothes washing machine. Extending outwardly and upwardly from the side wall of the hub, near the lower, open end thereof, at a predetermined angle with respect thereto, is an annular wall. The annular wall and wall of the central hub define a first chamber for receipt of liquid rinse agent to be dispensed.

Extending generally transversely outwardly from the lower end of the hub side wall beyond the free end of the annular wall, is a flange or base wall. An externally threaded annular wall portion depends from the free end of the flange. Beyond the threaded portion there is provided an annular lip seal. A second annular wall extends downwardly from the flange. The last-mentioned wall is spaced from the lower end of the wall of the central hub to define a cylindrical passageway therebetween for carrying liquid rinse agent into the wash water of the clothes washing machine. The flange and hub are joined by an annular wall having a series of apertures or openings formed therein through which rinse agent passes into the cylindrical passageway from a second chamber formed upon joining an outer cover member to the inner annular member.

The outer cover member has the shape of an inverted cup with an opening defined in the top wall thereof to permit rinse agent to be poured into the dispenser. The diameter of the opening is greater than the diameter of the top wall of the hub to permit liquid rinse agent to be poured into the first chamber of the dispenser without splashing the liquid into the clothes basket of the machine or onto the outer walls of the dispenser. Internal threads designed for mating engagement with the external threads of the inner annular member are provided about the rim of the cup. The last-mentioned rim is flared outwardly for mating engagement with the annular lip seal included on the inner member.

To assemble the dispenser, the cover member is placed over the inner member so that the respective threaded portions mate. Relative rotation of the portions screws the two pieces together. When joined, the second chamber mentioned heretofore, is defined between the side wall of the outer cup-shaped member and the upwardly extending annular wall of the inner annular member. The free end of the last-mentioned wall is separated from what would be the base wall of the cup-shaped member, providing communication between the first and second chambers at the top of the dispenser.

Figure 1:
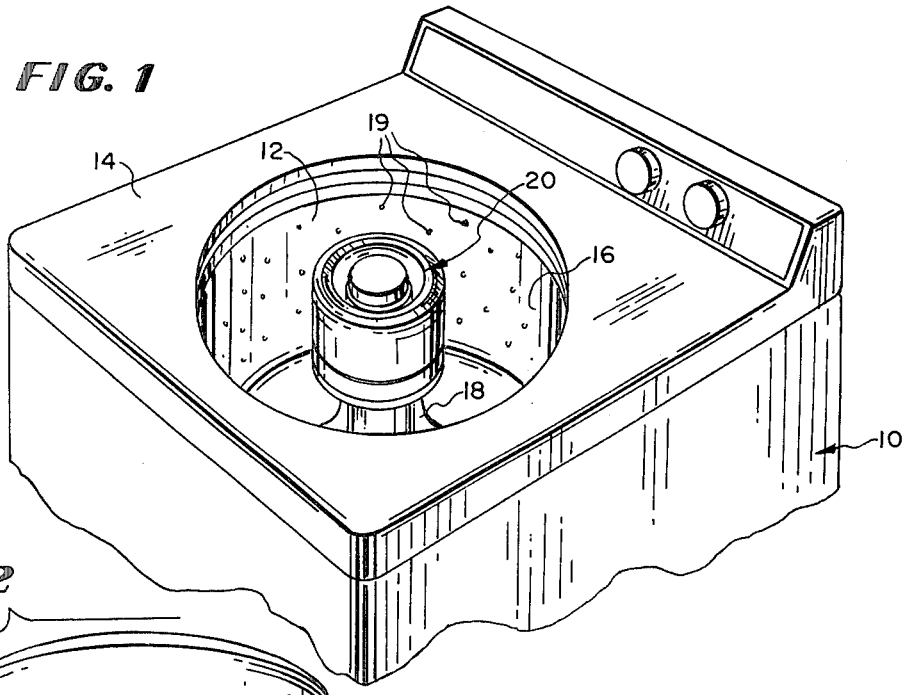
FIG. 1 is a fragmentary, perspective view of a top loading clothes washing machine illustrating a two-piece fabric softener dispenser according to the invention, mounted on the clothes agitator of the machine.

DETAILED DESCRIPTION OF THE DRAWING:

Referring now to the drawing in greater detail wherein like numerals have been employed throughout the various views to designate similar components, there is illustrated in FIG. 1, a clothes washing machine 10 of a conventional top loading design, shown with the door used to cover the clothes receiving opening 12, removed from top wall 14 of the machine.

Clothes washing machine 10 includes the usual vertical axis, open top, cylindrical clothes basket 16 in which clothes to be washed are placed and an agitator 18 extending upwardly along the central axis of the clothes basket. As is the practice in such a clothes washing machine, the agitator is designed to oscillate in a first direction within the clothes basket 16 during the wash cycle of the machine and subsequent thereto, spins in the opposite direction along with the clothes basket 16 to extract water from the clothes. The extracted water passes out of the clothes basket via apertures 19 provided in the side wall thereof.

As is shown in FIG. 1, a liquid rinse water agent dispenser 20, according to the invention, is mounted on the free end of agitator 18 of clothes washing machine 10. The dispenser is shown in greater detail in the remaining figures of the drawing.

Figure 2:
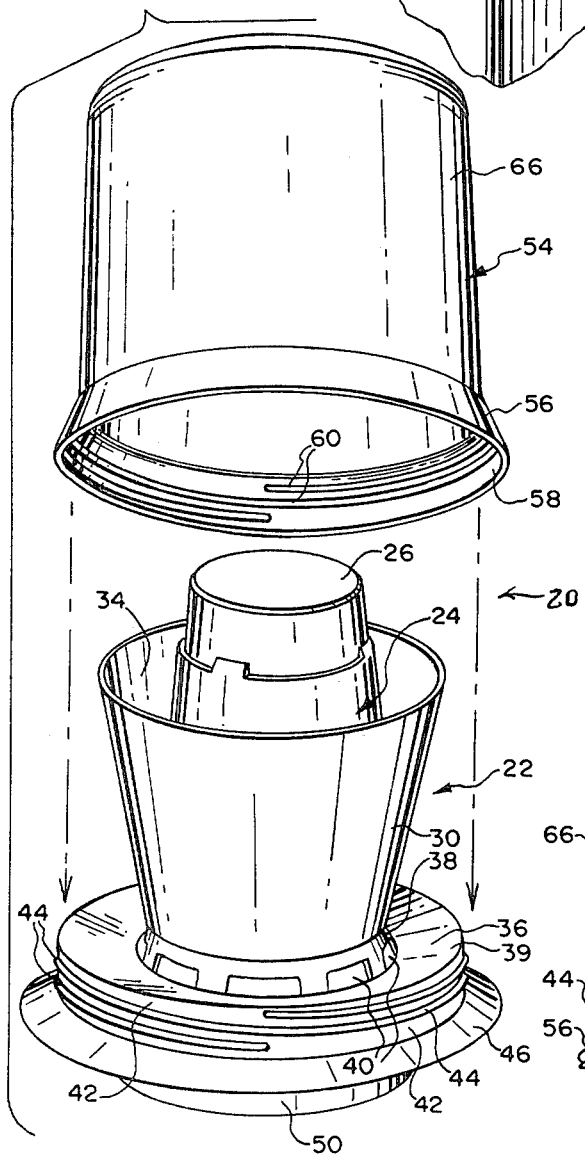
FIG. 2 is an exploded, isometric view of the fabric softener dispenser according to the invention.
Figure 4:
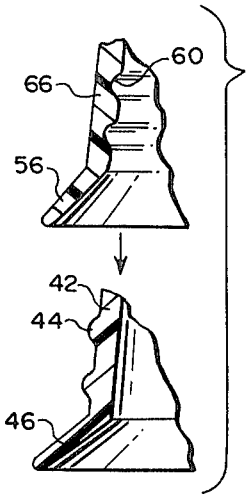
FIGS. 4 and 5 are enlarged, fragmentary, sectional views of the mating threaded portions of the two members comprising the fabric softener dispenser according to the invention, shown separated and in mating engagement, respectively.
Figure 5:
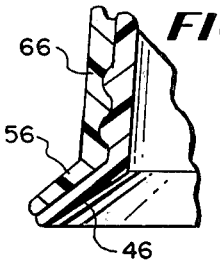

Turning to FIG. 2, it can be seen that dispenser 20 is of two-piece construction, including an inner annular member 22, and an outer cover 54, both preferably of molded plastic. Inner annular member 22 includes a central, hollow hub 24, having the general shape of a truncated cone with the upper end closed off by top wall 26. The hub is designed to be mounted on the upper end of agitator 18 of the clothes washing machine, the agitator extending into the lower open end 29 of the hub. Vertically extending ribs 27 are formed on the inner wall surface 28 of hub 24 to aid in retaining the liquid rinse agent dispenser in position on the agitator.

An annular wall 30 integrally formed with hub 24, extends outwardly and upwardly from side wall 32 thereof at a predetermined acute angle "a" with respect thereto. Side wall 32 of hub 24 and annular wall 30, define a first chamber 34 for initial receipt of liquid rinse agent to be dispensed into the clothes rinse water by dispenser 20. The angle "a" mentioned heretofore, is chosen so that annular wall 30 is predeterminedly inclined to permit the passage of liquid rinse agent from chamber 34 therealong, over free end 41 of the wall into a second chamber 65 (FIG. 3) of dispenser 20, to be described hereinafter.

Extending generally outwardly from hub 24, beneath chamber 34, is an annular flange or base wall 36. Flange 36 is joined to wall 30 by an annular wall 38, having a plurality of apertures 40 defined therein. The free end 39 of flange 36 extends radially outwardly beyond the free end 41 of annular wall 30.

Figure 3:
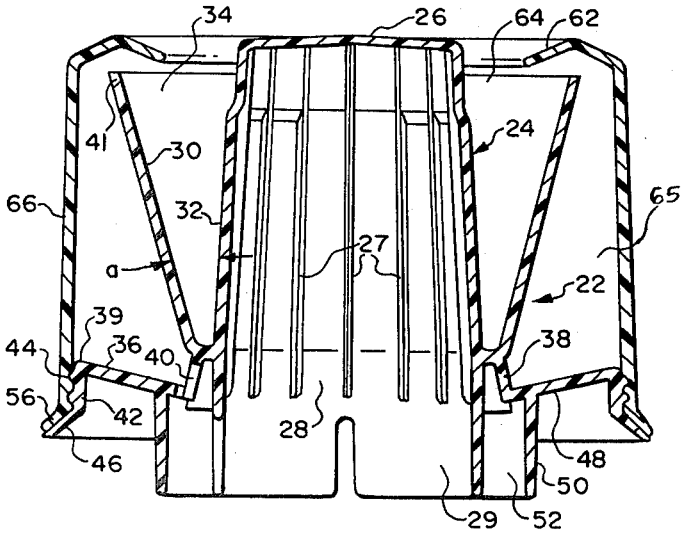
FIG. 3 is a side-sectional view of the fabric softener dispenser according to the invention, shown in an assembled condition.

At the free end of flange 36 is a depending annular wall 42 which has formed therealong, external threads 44, the purpose of which will be discussed hereinafter. Flange or base wall 36 as can be seen in FIG. 3 is pitched downwardly toward wall 38, to permit liquid rinse agent to flow through apertures 40 and out of the dispenser. This will be described in greater detail when discussing the operation of the dispenser.

Extending outwardly from the free end of depending wall 42 is an annular flexible lip 46 provided to serve as an additional liquid seal for the dispenser.

Extending vertically downwardly from the lower surface 48 of the flange 36, substantially parallel to the lower portion of wall 32 of hub 24, is an annular wall 50. Wall 50 is spaced from annular hub wall 32 to define a passageway 52 therebetween, through which the liquid rinse agent passes from the dispenser into the rinse water in basket 16 of the clothes washing machine.

The cover of the two-piece liquid rinse agent dispenser 20 according to the invention comprises an inverted cup member 54 designed to be received over the inner annular member. Inverted cup member 54 has an outwardly flared rim 56 provided along the lower end 58 thereof. The rim includes internal threads 60 designed for mating engagement with external threads 44 of annular member 22.

Top wall 62 of the cup member includes a central circular opening 64 (FIG. 3) through which liquid rinse agent is poured into first chamber 34 of the dispenser. Central opening 64 of cup member 54 is of a diameter greater than that of top wall 26 of hub 24 to permit liquid rinse agent to be poured into chamber 34 without splashing the rinse agent into basket 16 or onto top walls 62, 26, respectively. Top wall 62 of member 54 extends partially over the free end 41 of annular wall 30, but is separated therefrom to permit liquid rinse agent to be transferred by centrifugal force from chamber 34, over end 41 of wall 30, and into a second chamber 65 defined by the side wall 66 of cup member 54 and annular wall 30.

To assemble the dispenser, inverted cup member 54 is placed over inner annular member 22 so that the threads 44, 60 mate. Relative rotation of members 54 and 22 joins the members. When the members have been fully joined, flexible lip 46 and rim 56 are in close engagement (FIG. 3). The mating threads 44, 60 and the mating lip 46 and 56, provide liquid tight seals to avoid leakage of liquid rinse agent from the dispenser. While the seal comprising lip 46 and rim 56 has been provided to ensure that no leakage of rinse agent from the dispenser occurs, threads 44, 60 when fully mated also provide an adequate leak proof seal for the dispenser. As such, the lip seal arrangement could, if desired, be eliminated from the dispenser.

Once in an assembled condition, the dispenser 20 is mounted on agitator 18 of the clothes washing machine by placing end 29 of hub 24 onto the top of the agitator and pushing it downwardly thereover. Agitator 18 is received in hollow hub 24 and held thereon frictionally by engagement with ribs 27 formed on the interior wall 28 of the hub.

Once is place on agitator 18, liquid rinse agent is poured through opening 64 of the dispenser into first chamber 34. The liquid rinse agent remains in chamber 34 during the wash cycle as agitator 18, with dispenser 20, oscillates. During a subsequent cycle of the machine, basket 16 and agitator 18 with dispenser 20, are spun at high speed to extract water from clothes placed in basket 16. At that time, the liquid rinse agent initially received in chamber 34 is, by the centrifugal force created during the high speed rotation of dispenser 20, transferred upwardly along inclined annular wall 30, over end 41 thereof and into chamber 65. No liquid rinse agent leaks from chamber 65 of the dispenser as the mating threads 44, 60 provide a liquid tight seal thereagainst. The engagement of lip 46 and rim 56 as described heretofore, provide a second seal against leakage of rinse agent from the dispenser.

When the extraction cycle is completed, the basket and agitator return to a rest condition while the rinse water is introduced into clothes basket 16. At the same time, liquid rinse agent, now in chamber 65, flows down along inclined flange or base wall 36, through apertures 40 in wall 38, and via passageway 52 into the rinse water.

When the clothes washing operation has been completed, it is desirable to clean dispenser 20. This is a simple matter as all that need be done is to unscrew the cup-shaped cover 54 from inner annular member 22, separating the two pieces. Once separated, hot tap water can be run over the pieces, which then have virtually all surfaces thereof exposed.

As can be seen from the description provided heretofore, the two piece rinse agent dispenser 20 according to the invention is of simple construction, yet permits easy assembly and disassembly of the pieces thereof for easy cleaning and the like. Because of its structure, dispenser 20 is resistant to wear at the place of joinder and is relatively stable during rapid rotation of the agitator of the clothes washing machine upon which the dispenser is mounted.

While a particular embodiment of the invention has been shown and described, it should be understood that the invention if not limited thereto since many modifications thereof may be made. It is therefore contemplated to cover by the subject application any and all such modifications that fall within the true spirit and scope of the appended claims.

I claim:

1. A two piece liquid rinse agent dispenser for use in a clothes washing machine having a clothes basket with an open upper end and a clothes agitator extending upwardly at the central axis of said clothes basket, both of which are mounted for rapid rotation thereabout, said dispenser including in combination:

an inner annular member including a central, hollow hub having an annular side wall, a closed upper end and an open, lower end for receipt on said agitator, the hollow hub freely receiving the agitator therewithin without mechanical connection between the hub and the agitator, a first annular wall extending outwardly from said hub at a predetermined angle with respect thereto to define a first chamber between said side wall and said first annular wall, said first chamber having an open upper end, a lower annular flange joined to said hub, and first attachment means provided along the free end of said flange and an inverted cup-shaped cover dimensioned for receipt over said inner annular member having a generally cylindrical side wall, an upper end wall and an open lower end, said cover including an opening defined in said upper end wall through which said liquid rinse agent is poured into said chamber and second attachment means provided along said open, lower end of said cover, said first and second attachment means joining said cover and said inner annular member and producing a liquid tight seal therebetween upon connection of the former to the latter, the first and second attachment means constituting the sole connection between the inner annular member and the cover and connecting said inner annular member and the cover to each other solely about the respective peripheries of the free end of the flange and of the lower end of the cover, the side wall of said cover and said first annular wall of said inner annular member defining a second chamber for receipt of said liquid rinse agent upon rotation of said dispenser at a predetermined speed.

2. A two piece liquid rinse agent dispenser as claimed in claim 1 further including a second annular wall having a plurality of apertures therethrough, joining said flange at a first end to said hub, beneath said first chamber, said liquid rinse agent flowing from said second chamber via said aperture second annular wall subsequent to the termination of rotation of said dispenser at said predetermined speed.

3. A two piece liquid rinse agent dispenser as claimed in claim 2 and further including a third annular wall depending from said flange on the opposite side of the flange from the first annular wall and a lower annular side wall depending from said hub, the third annular wall being spaced from the lower annular side wall to define a passageway therebetween through which said liquid rinse agent passes from said second chamber into said clothes basket.

4. A two piece liquid rinse agent dispenser as claimed in claim 1 wherein said inner annular member includes a second annular wall disposed at the free end of said flange, wherein said first and second attachment means include external threads formed along said second annular wall of said inner annular member and internal threads formed along the inner surface of said side wall of said cover, near the open, lower end thereof, respectively, and wherein said cover and inner annular member are joined by mating engagement of said external and internal threads with relative rotation of said cover and inner annular member, the connection of the inner annular member to the cover acting to form a seal therebetween about the respective peripheries of the second annular wall and the inner surface of said side wall of said cover.

5. A two piece liquid rinse agent dispenser as claimed in claim 4 further including an annular lip extending from said annular wall at the free end of said flange of said inner annular member and an outwardly extending rim portion formed on said cover for mating engagement with said lip upon joining said cover and inner annular member thereby to provide a further liquid tight seal for preventing liquid rinse agent from leaking from said dispenser.

6. A two piece liquid rinse agent dispenser as claimed in claim 1 further including ribs defined along the interior surface of said hollow hub for engagement with said clothes agitator for securing said dispenser thereon.

7. A two piece liquid rinse agent dispenser for use in a clothes washing machine having a clothes basket with an open upper end mounted for rotation about a central vertical axis and a clothes agitator extending upwardly along the central axis thereof, said agitator being rotatable with said basket, said dispenser including in combination:

an inner annular member including a central, hollow hub with an annular side wall and an open, lower end for receipt on said agitator, an annular wall member joined to said hub to define a first liquid rinse agent receiving chamber between said hub and annular wall member, an annular base wall member extending from said hub outwardly thereabout, said base wall member including external threads defined along the free end thereof, and a cover having the shape of an inverted cup, including an annular side wall, an upper end wall, and an open lower end, said cup being dimensioned for receipt over said inner annular member, said open end of said cover including threads defined along the inner surface of said side wall for mating engagement with said external threads upon placement of said cover over said inner annular member, said cover and inner annular member being joined by relative rotation thereof, the respective threads constituting the sole connection between the inner annular member and the cover and connecting said inner annular member and the cover to each other solely about the respective peripheries of the free end of the base wall member and of the lower end of the cover, the respective threads further acting to seal the connection between the inner annular member and the cover.

8. A two piece liquid rinse agent dispenser as claimed in claim 7 wherein said inner annular member further includes an annular lip extending outwardly at the free end of said base wall member, and wherein said cover includes an outwardly extending rim portion provided along the open end thereof, said lip and rim portin being located for mating engagement upon joinder of said cover and inner annular member to provide a liquid tight seal therebetween.

9. A two piece liquid rinse agent dispenser as claimed in claim 7 further including a second annular wall having a plurality of apertures therethrough joining said base wall member to said hub beneath said first chamber, and wherein upon joining said cover and inner annular member, a second rinse agent receiving chamber is defined between the side wall of said cover and said annular wall member, said second chamber being disposed radially outwardly from said first chamber, said liquid rinse agent being transferred from said first to said second chamber upon rapid rotation of said dispenser and thereafter upon termination of said rotation, the rinse agent flowing from said chamber via said apertures in said second annular wall into said clothes basket.

10. The liquid rinse agent dispenser of claim 1 wherein the opeing in the upper end wall of the cover is essentially circular and is centrally disposed therein, the opening being of a diameter greater than the closed upper end of the hub, the upper end of the hub extending freely through the opening, the diameter of the opening being less than the diameter of upper peripheral portions of the first annular wall, rinse agent being charged into the first chamber through said opening.

* * * * *